US011598234B2

(12) United States Patent
Takamatsu et al.

(10) Patent No.: US 11,598,234 B2
(45) Date of Patent: Mar. 7, 2023

(54) BREATHER DEVICE AND ENGINE

(71) Applicant: Yanmar Power Technology Co., Ltd., Osaka (JP)

(72) Inventors: Kota Takamatsu, Osaka (JP); Masato Sugimoto, Osaka (JP)

(73) Assignee: Yanmar Power Technology Co., Ltd., Osaka (JP)

( * ) Notice: Subject to any disclaimer, the term of this patent is extended or adjusted under 35 U.S.C. 154(b) by 107 days.

(21) Appl. No.: 17/059,264

(22) PCT Filed: May 8, 2019

(86) PCT No.: PCT/JP2019/018374

§ 371 (c)(1),
(2) Date: Nov. 27, 2020

(87) PCT Pub. No.: WO2019/230310

PCT Pub. Date: Dec. 5, 2019

(65) Prior Publication Data

US 2021/0207505 A1 Jul. 8, 2021

(30) Foreign Application Priority Data

May 31, 2018 (JP) ..... JP2018-105726

(51) Int. Cl.

| | |
|---|---|
| ***F01M 13/04*** | (2006.01) |
| ***F01P 3/12*** | (2006.01) |
| *F01M 13/00* | (2006.01) |

(52) U.S. Cl.

CPC ..... *F01M 13/04* (2013.01); *F01P 3/12* (2013.01); *F01M 13/0011* (2013.01); *F01M 2013/0044* (2013.01); *F01M 2013/0433* (2013.01); *F01M 2013/0461* (2013.01)

(58) Field of Classification Search

CPC ..... F01M 13/04; F01M 13/0011; F01M 2013/0044; F01M 2013/0433; F01M 2013/0461; F01M 13/0416; F01P 3/12

See application file for complete search history.

(56) References Cited

U.S. PATENT DOCUMENTS 6,412,478 B1 * 7/2002 Ruehlow ..... F01M 13/0416 123/41.86

FOREIGN PATENT DOCUMENTS

JP H05-083310 11/1993

* cited by examiner

*Primary Examiner* — Jacob M Amick
(74) *Attorney, Agent, or Firm* — Chris Mizumoto

(57) ABSTRACT

This breather device separates engine oil included in a blow-by gas. The breather device comprises a first route, an acceleration route, a branching route, and turn-back routes. The blow-by gas flows to the first route. The acceleration route is connected to a downstream side of the first route, and has a flow channel cross-sectional area smaller than that of the first route. The branching route is connected to a downstream side of the acceleration route, configured including a wall part orthogonal to the acceleration route, and branched into two routes by the wall part. The turn-back routes are connected to one route branching at the branching route, and are turned back so as to be parallel to the acceleration route and to head in the opposite direction from a progressing direction.

5 Claims, 5 Drawing Sheets

| | |
|---|---|
| ○ | POSITION WHERE ENGINE OIL MIST HAVING LARGE PARTICLE DIAMETER IS LIKELY TO BE SEPARATED |
| ◌ | POSITION WHERE ENGINE OIL MIST HAVING SMALL PARTICLE DIAMETER IS LIKELY TO BE SEPARATED |

BREATHER DEVICE AND ENGINE

CROSS-REFERENCE

This application is a US National Stage Application under 35 U.S.C. § 371 of International Application No. PCT/JP2019/018374 filed May 8, 2019, which claims foreign priority of JP2018-105726 filed May 31, 2018, the disclosures of which are hereby incorporated by reference in their entirety.

TECHNICAL FIELD

The present invention mainly relates to a breather device that separates engine oil contained in blow-by gas.

BACKGROUND ART

In Patent Literature 1, a cylinder head cover having a function of separating engine oil contained in blow-by gas that has leaked from a combustion chamber is disclosed. This head cover is formed with a gas channel through which the blow-by gas introduced from a cylinder head side is discharged to the outside. This gas channel is formed with a high-pressure portion having a small channel cross-sectional area. The blow-by gas, a speed of which is accelerated to a high speed when flowing through the high-pressure portion, collides with a wall portion. In this way, the engine oil contained in the blow-by gas is separated.

CITATION LIST

Patent Literature

Patent Literature 1: Japanese Unexamined Patent Application Publication No. 2017-150435

DISCLOSURE OF INVENTION

Problems to be Solved by the Invention

However, the engine oil contained in the blow-by gas is not sufficiently separated in the configuration disclosed in Patent Literature 1, and thus improvement of the configuration has been desired.

The present invention has been made in view of the above circumstance, and a main object thereof is to provide a breather device having a configuration capable of sufficiently separating engine oil contained in blow-by gas.

Means for Solving the Problems

The problem to be solved by the present invention is as described above. Next, a description will be made on means for solving the problem and effects thereof.

A first aspect of the present invention provides a breather device having the following configuration. That is, this breather device separates engine oil contained in blow-by gas. This breather device includes a first route, an acceleration route, a branching route, and a turn-back route. The blow-by gas flows through the first route. The acceleration route is connected to a downstream side of the first route and has a smaller channel cross-sectional area than the first route. The branching route is connected to a downstream side of the acceleration route, includes a wall portion that is orthogonal to the acceleration route, and is branched into two routes by the wall portion. The turn-back route is connected to one of the branched routes of the branching route and is turned back in a manner to be parallel to the acceleration route and to have a reverse advancing direction from that of the acceleration route.

In this way, the engine oil mist contained in the blow-by gas is carried by the blow-by gas, a flow rate of which is increased in the acceleration route, and collides with the wall portion in the branching route. As a result, the engine oil can be separated from the blow-by gas. In addition, since the turn-back route causes the blow-by gas to turn back, the engine oil can be separated from the blow-by gas by inertia.

The breather device includes a portion in which an advancing direction of the route is changed by 90 degrees. Outer wall portions constituting such a portion are constructed of two wall portions that are orthogonal to each other and are connected to each other.

In this way, compared to the case where the wall portions constituting an outer side of a corner portion are connected by an arcuate surface, a flow of the blow-by gas is likely to be disturbed and stagnate, and a flow rate of the blow-by gas is likely to be reduced. In particular, the engine oil mist having a small particle diameter is likely to be collected in a location, where the stagnation occurs, on the outer side of the corner portion. As a result, it is possible to further reliably separate the engine oil from the blow-by gas.

The breather device preferably includes a merging route that is formed on a downstream side of the branching route and that merges the two branched routes of the branching route.

As a result, the engine oil that is contained in the two branched routes can collide with each other. Thus, it is possible to further reliably separate the engine oil from the blow-by gas.

The breather device preferably has the following configuration. That is, this breather device includes a receiving portion that receives the engine oil separated from the blow-by gas. The receiving portion includes an oil delivery portion that delivers the engine oil separated from the blow-by gas. The oil delivery portion is a stepped groove portion in which an up portion and a down portion are alternately and repeatedly provided. A height of the up portion is increased toward a downstream side of a route through which the engine oil returns. A height of the down portion is reduced toward the downstream side of the route through which the engine oil returns. The height of the down portion is changed more steeply than that of the up portion.

In this way, the engine oil can move along the up portion by vibration of the engine. Meanwhile, since the height of the down portion is steeply changed, the engine oil is less likely to flow reversely. As a result, it is possible to further reliably move the engine oil.

A second aspect of the present invention provides an engine having the following configuration. That is, this engine includes the breather device and a vaporizer. The vaporizer vaporizes liquid fuel by using heat of an engine coolant. The breather device is cooled when the engine coolant that has been subjected to heat exchange with the vaporizer flows through the breather device.

It is possible to increase viscosity of the engine oil by cooling the blow-by gas in the breather device using the engine coolant, a temperature of which has been reduced by the heat exchange with the vaporizer. Thus, it is possible to further reliably separate the engine oil from the blow-by gas.

DESCRIPTION OF EMBODIMENTS

Figure 1:
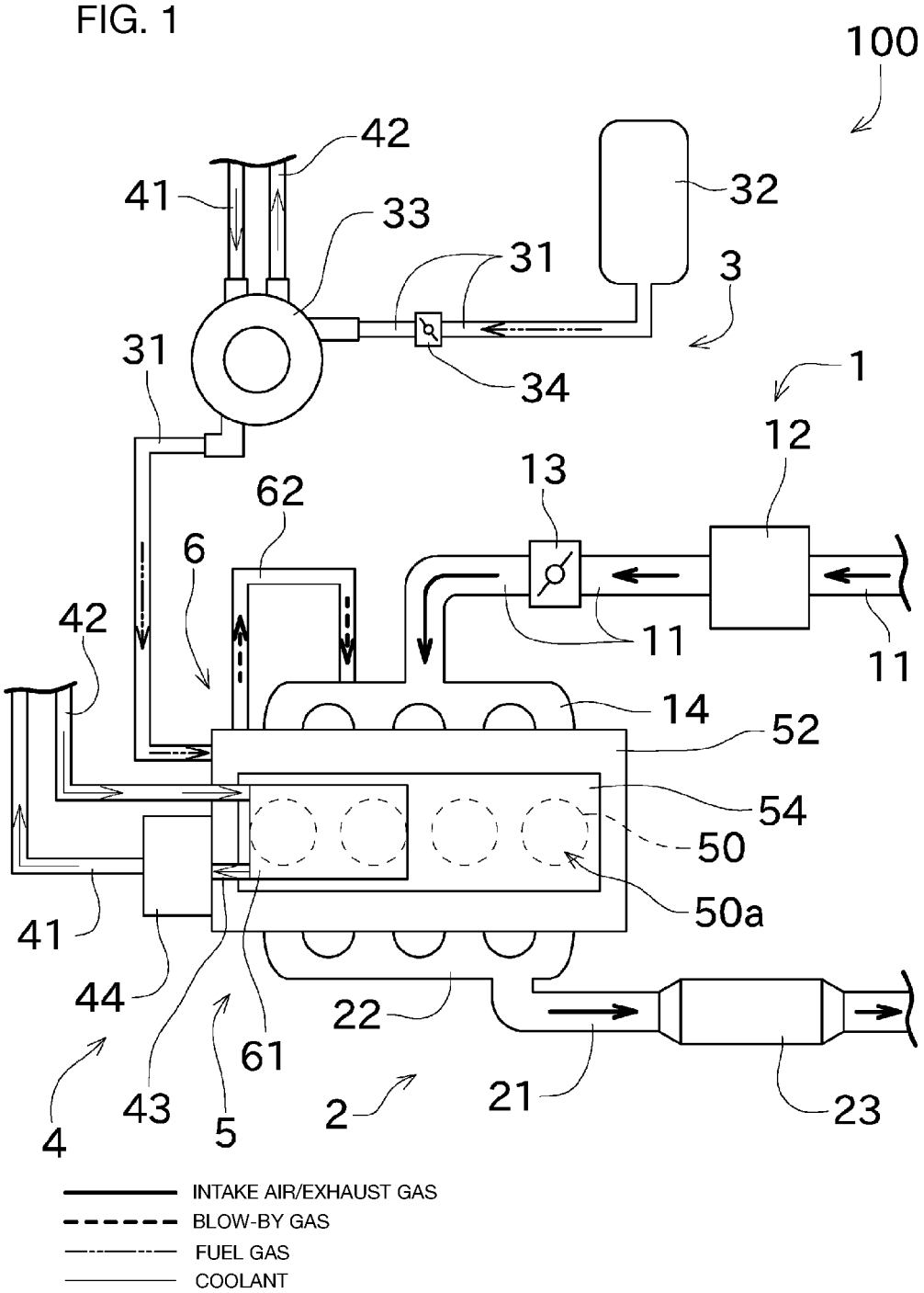
FIG. 1 is a schematic view illustrating flows of intake air/exhaust gas, a coolant, fuel gas, and the like, of an engine according to an embodiment of the present invention.
Figure 2:
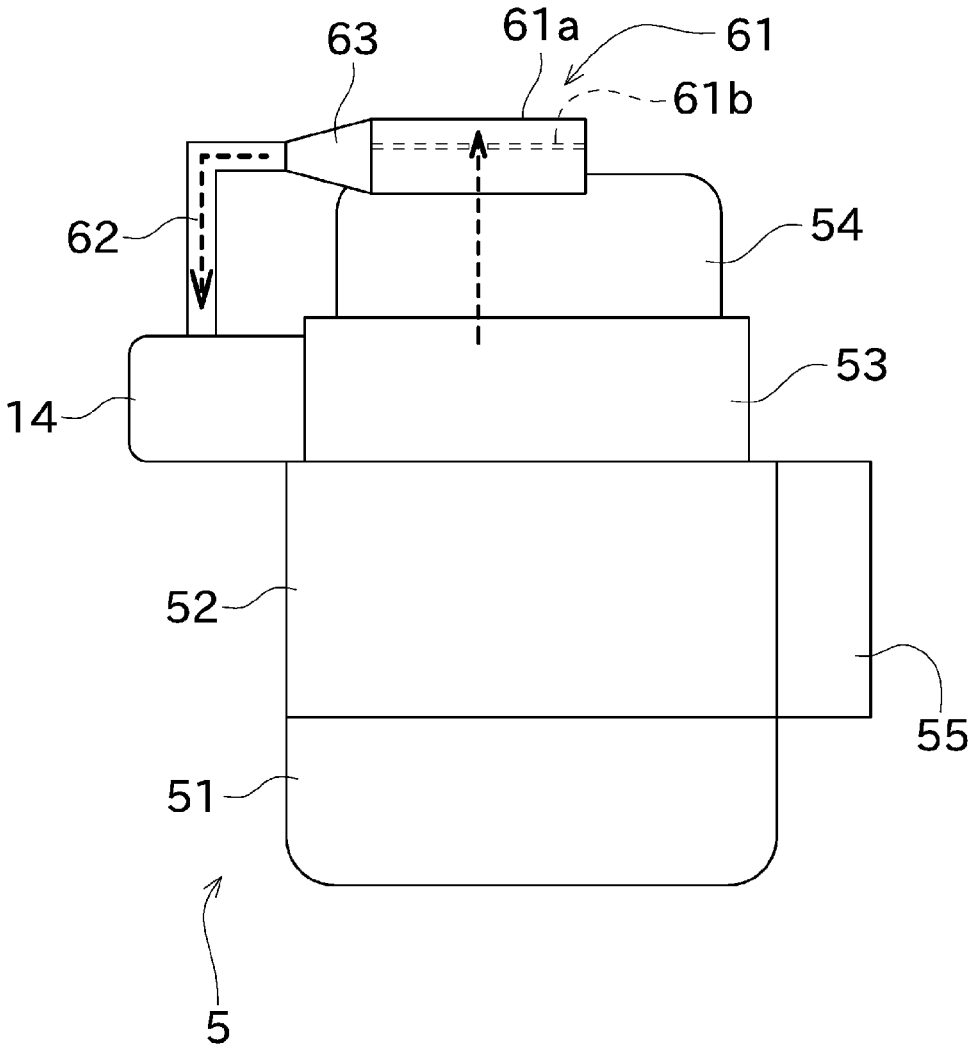
FIG. 2 is a schematic view illustrating a configuration of the engine.

Next, a description will be made on an embodiment of the present invention with reference to the drawings. FIG. 1 is a schematic view illustrating flows of intake air/exhaust gas, fuel gas, and the like of an engine 100 according to the embodiment of the present invention. FIG. 2 is a schematic view of the engine 100.

The engine 100 illustrated in FIG. 1 is a gas engine that generates power by burning the fuel gas such as petroleum gas or natural gas. The engine 100 may be another type of the internal combustion engine such as a gasoline engine or a diesel engine. The engine 100 is used as a drive source of a generator, a heat pump, a mobile body, or the like, for example. As illustrated in FIG. 1 and the like, this engine 100 includes, as main components, an intake section 1, an exhaust section 2, and a fuel gas supply section 3, a cooling section 4, an engine body 5, and a blow-by gas recirculation section 6, for example.

The intake section 1 suctions air from the outside. The intake section 1 includes an intake pipe 11, an air cleaner 12, a throttle valve 13, and an intake manifold 14.

The intake pipe 11 constitutes an intake route, and the air that has suctioned from the outside (hereinafter, intake air) can flow toward the engine body 5 through the intake pipe 11.

The air cleaner 12 includes a cleaner element for removing foreign substances in the intake air. The intake air that has been purified when flowing through the air cleaner 12 is delivered to the intake manifold 14.

The throttle valve 13 is arranged in an intermediate portion of the intake route. An opening degree of the throttle valve 13 is changed according to a control command from an engine control unit (ECU), which is not illustrated. In this way, the throttle valve 13 changes a channel cross-sectional area. As a result, it is possible to adjust an amount of the intake air to be supplied to the intake manifold 14 via the throttle valve 13.

The intake manifold 14 is connected to a downstream end portion of the intake pipe 11 in a flow direction of the intake air. The intake manifold 14 divides the intake air, which has been supplied via the intake pipe 11, according to the number of cylinders 50 and can thereby supply the intake air to a combustion chamber in each of the cylinders 50.

Each of the cylinders 50 is formed with a combustion chamber 50*a*. The gaseous fuel gas that is supplied from the fuel gas supply section 3 is distributed and introduced into the combustion chamber 50*a* of each of the cylinders 50. A detailed description on a configuration of the fuel gas supply section 3 will be made below.

In the combustion chamber 50*a*, mixed gas in which the gaseous fuel gas and the intake air supplied from the intake manifold 14 are mixed is compressed and ignited at appropriate timing by an appropriate method (for example, ignition by a spark plug). A piston, which is not illustrated and is arranged in the cylinder 50, reciprocates linearly by a propulsive force that is obtained by explosion in the combustion chamber 50*a*. The thus-obtained power is converted into circular motion via a crankshaft, which is not illustrated, and the like and is transmitted to an appropriate device.

The exhaust section 2 discharges the exhaust gas that is produced in the combustion chamber 50*a* to the outside. As illustrated in FIG. 1, the exhaust section 2 includes an exhaust pipe 21, an exhaust manifold 22, and an exhaust gas purifier 23.

The exhaust pipe 21 constitutes an exhaust route, and the exhaust gas that has been produced in the combustion chamber 50*a* can flow therethrough to the outside.

The exhaust manifold 22 is connected to an upstream end portion of the exhaust pipe 21 in a flow direction of the exhaust gas. The exhaust manifold 22 collectively guides the exhaust gas produced in the combustion chambers 50*a* to the exhaust pipe 21.

The exhaust gas purifier 23 is provided in a downstream end portion of the exhaust pipe 21. The exhaust gas purifier 23 uses a catalyst or the like to remove harmful components and particulate matters such as nitrogen oxide (NOx), carbon monoxide (CO), and hydrocarbons (HC) contained in the exhaust gas, and thereby purifies the exhaust gas.

As illustrated in FIG. 1, the fuel gas supply section 3 includes a fuel gas supply pipe 31, a fuel gas tank 32, a vaporizer 33, and a fuel gas valve 34.

The fuel gas supply pipe 31 constitutes a fuel gas supply route through which the fuel gas is supplied from the fuel gas tank 32 to the combustion chamber 50*a*. In an intermediate portion of this fuel gas supply route, the fuel gas valve 34 and the vaporizer 33 are arranged in this order from an upstream side in a flow direction of the fuel gas.

The fuel gas tank 32 stores liquid fuel gas such as LPG. The fuel gas tank 32 is connected to an upstream end portion of the fuel gas supply pipe 31 in the flow direction of the fuel gas. The liquid fuel gas that is stored in the fuel gas tank 32 is supplied to the vaporizer 33 by a pressure, a fuel pump, which is not illustrated, or the like.

The vaporizer 33 is a water-heated vaporizer, and vaporizes the liquid fuel gas supplied from the fuel gas tank 32. More specifically, the liquid fuel gas that is supplied to the vaporizer 33 is depressurized, and heat of the liquid fuel gas is exchanged with a heat medium such as a coolant (an engine coolant) for cooling the engine 100. In this way, the fuel gas can be vaporized. The vaporizer 33 may be configured to vaporize the liquid fuel gas without using the coolant. In addition, in the case where the engine 100 is the gasoline engine or the diesel engine, the fuel does not have to be vaporized. Thus, the vaporizer 33 is unnecessary.

The engine body 5 is a component that burns the fuel to generate the power. As illustrated in FIG. 2, the engine body 5 includes an oil pan 51, a cylinder block 52, a cylinder head 53, a head cover 54, and a gear case 55.

The oil pan 51 is a container for storing the engine oil that is lubricating oil for the engine 100. The oil pan 51 is provided in a lower portion of the engine 100. The oil pan 51 is formed as the container, an upper portion of which is opened, and an internal storage space and the cylinder block 52 communicate with each other. In this way, the engine oil that has flowed through the cylinder block 52 can easily return to the oil pan 51.

The engine oil that is stored in the oil pan 51 is suctioned by an engine oil pump, which is not illustrated and is provided to the engine 100, and is thereafter supplied to each of the sections (for example, inside of the cylinder block 52 and inside of the gear case 55) of the engine 100. The engine oil that has flowed through the sections of the engine 100 returns to the oil pan 51 and is stored therein.

The cylinder block 52 is attached to an upper side of the oil pan 51. The cylinder block 52 is formed with a space for accommodating the crankshaft and the like and the plural cylinders 50 in each of which the piston is accommodated.

The cylinder head 53 is attached to an upper side of the cylinder block 52. Together with the cylinder block 52, the cylinder head 53 constitutes the above-described combustion chamber 50*a*. An injector for injecting the fuel is attached to the cylinder head 53.

The head cover 54 is provided on an upper side of the cylinder head 53, and accommodates a valve operation mechanism including a push rod, a rocker arm, and the like, which are not illustrated and operate an intake valve and an exhaust valve.

The gear case 55 is arranged on a side surface of the cylinder block 52, the cylinder head 53, or the like (in detail, a side surface at an end in a direction of the crankshaft). In the gear case 55, a crank gear, a valve operation gear, a pump gear, and the like are arranged. When the crank gear rotates according to rotation of the crankshaft, the valve operation gear and the pump gear, each of which meshes with the crank gear, rotate. In this way, the valve operation mechanism and the engine oil pump are operated in synchronization with the rotation of the crankshaft.

The blow-by gas recirculation section 6 collects the blow-by gas that is produced in the engine body 5, and returns the blow-by gas to the intake route. More specifically, the blow-by gas leaks from the combustion chamber 50*a* into the cylinder block 52, and flows to the cylinder head 53 and the head cover 54. The above flow of the blow-by gas from the cylinder block 52 to the head cover 54 is an example, and the flow of the blow-by gas differs by a configuration of the engine body 5, and the like. As illustrated in FIG. 1 and FIG. 2, the blow-by gas recirculation section 6 includes a breather device 61, a blow-by gas recirculation pipe 62, and a PCV valve 63.

The breather device 61 is arranged on top of the head cover 54. The breather device 61 is integrally formed with the head cover 54, and releases the blow-by gas to maintain a balance between an internal pressure of the cylinder block 52 and atmospheric pressure. The breather device 61 may be a different component from the head cover 54. An oil separation route is formed between a ceiling portion 61*a* that is a lower surface of an upper plate (a lid portion) of the breather device 61 and a plate-shaped receiving portion 61*b* that is arranged below the ceiling portion 61*a*. The engine oil mist that is contained in the blow-by gas is separated when flowing through the oil separation route, drops to the receiving portion 61*b*, and returns into the cylinder block 52. A detailed description on this oil separation route will be made below.

The blow-by gas recirculation pipe 62 constitutes a route through which the blow-by gas discharged from the breather device 61 is delivered to the intake manifold 14. The blow-by gas recirculation pipe 62 may be configured to connect the breather device 61 and the intake pipe 11 (particularly, a portion on a downstream side of the throttle valve 13 and on an upstream side of the intake manifold 14 in the flow direction of the intake air).

The PCV valve 63 is arranged between the breather device 61 and the blow-by gas recirculation pipe 62. PCV stands for positive crankcase ventilation. The PCV valve 63 is configured to be opened when the intake section 1 has a negative pressure during operation of the engine 100, and the like to move the blow-by gas to the blow-by gas recirculation pipe 62.

The cooling section 4 circulates the coolant such as water to cool the engine 100. The engine body 5 is formed with a water jacket, which is not illustrated, and the coolant, which has flowed through the water jacket, and a temperature of which is increased, is cooled by a cooler such as a radiator or a cooling tower. This coolant is also supplied to the vaporizer 33 and the breather device 61. Hereinafter, a specific description will be made. As illustrated in FIG. 1, the cooling section 4 includes a first coolant pipe 41, a second coolant pipe 42, a third coolant pipe 43, and a coolant pump 44.

The first coolant pipe 41 constitutes a route through which the coolant is supplied to the vaporizer 33. The coolant pump 44 pumps out the coolant and thereby supplies the coolant to the vaporizer 33 via the first coolant pipe 41. In addition, a route, which is not illustrated, for heat exchange between the coolant and the vaporizer 33 is formed in the vaporizer 33. A temperature of the coolant flowing through the first coolant pipe 41 is higher than a temperature of the vaporizer 33. Accordingly, due to the heat exchange between the coolant and the vaporizer 33, the temperature of the coolant is reduced, and the temperature of the vaporizer 33 is increased. In this way, the vaporization of the fuel gas can be promoted.

The second coolant pipe 42 constitutes a route through which the coolant, the temperature of which is reduced by the heat exchange with the vaporizer 33, is supplied to the breather device 61. The route, which is not illustrated, for the heat exchange between the coolant and the breather device 61 is formed in the breather device 61. In this way, the temperature of the coolant is increased, and a temperature of the breather device 61 is reduced. When the temperature of the breather device 61 is reduced, viscosity of the engine oil that is contained in the blow-by gas flowing through the breather device 61 can be increased. As a result, particles of the engine oil mist can easily be bonded, and thus the engine oil can further reliably be separated. The coolant that has been cooled by the cooler such as the radiator may be supplied to the breather device 61.

The third coolant pipe 43 constitutes a route through which the coolant, the temperature of which is increased by the heat exchange with the breather device 61, returns to the coolant pump 44.

Figure 4:
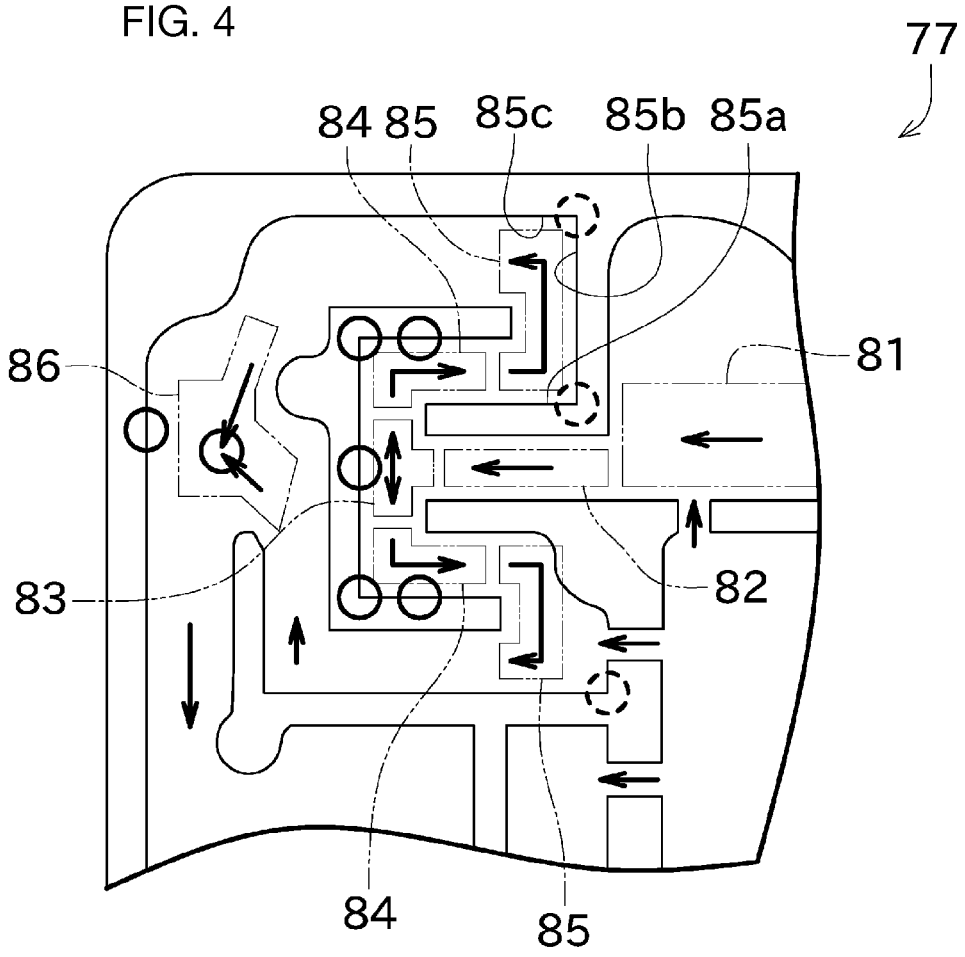
FIG. 4 is an enlarged view of a fourth region of the oil separation route.
Figure 5:
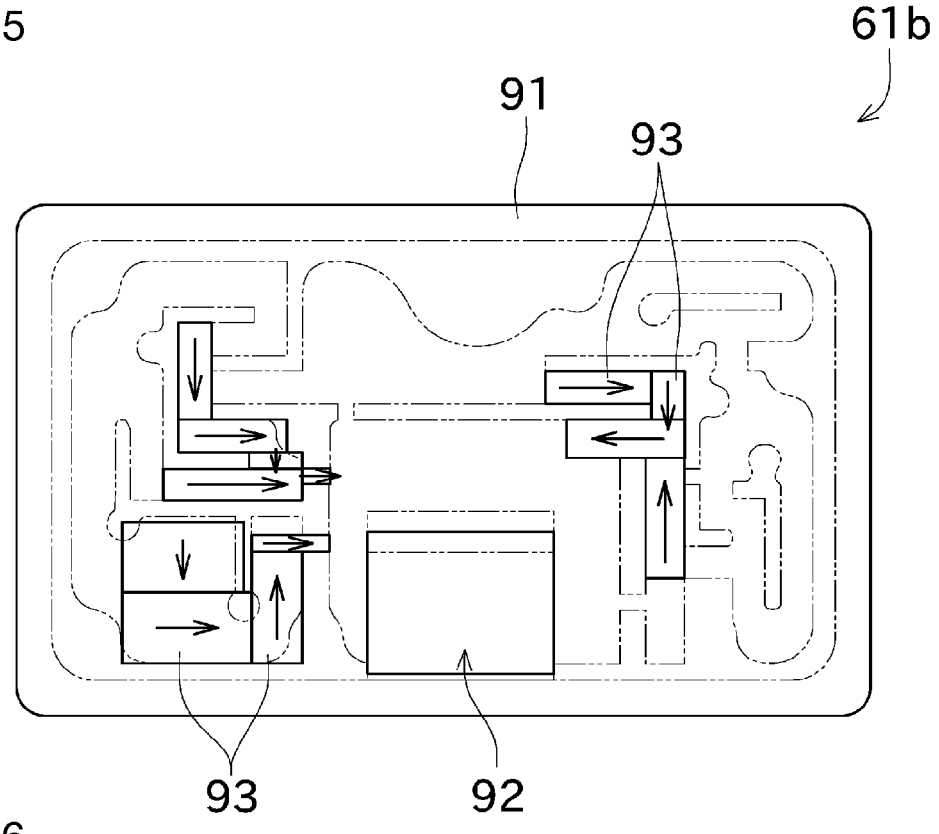
FIG. 5 is a plan view illustrating an oil return hole and an oil delivery portion that are formed in a receiving portion.

Next, a description will be made on the oil separation route formed in the breather device 61 with reference to FIG. 2 to FIG. 5. In the following description, terms for explaining directions such as parallel and orthogonal include configurations deviating from the parallel or orthogonal direction due to a manufacturing error or another reason instead of only strictly including configurations such as parallel and orthogonal. The same applies to terms related to not only the directions but also lengths. In FIG. 5, a wall portion that is formed in the ceiling portion 61*a* is indicated by a chain line for reference.

Figure 3:
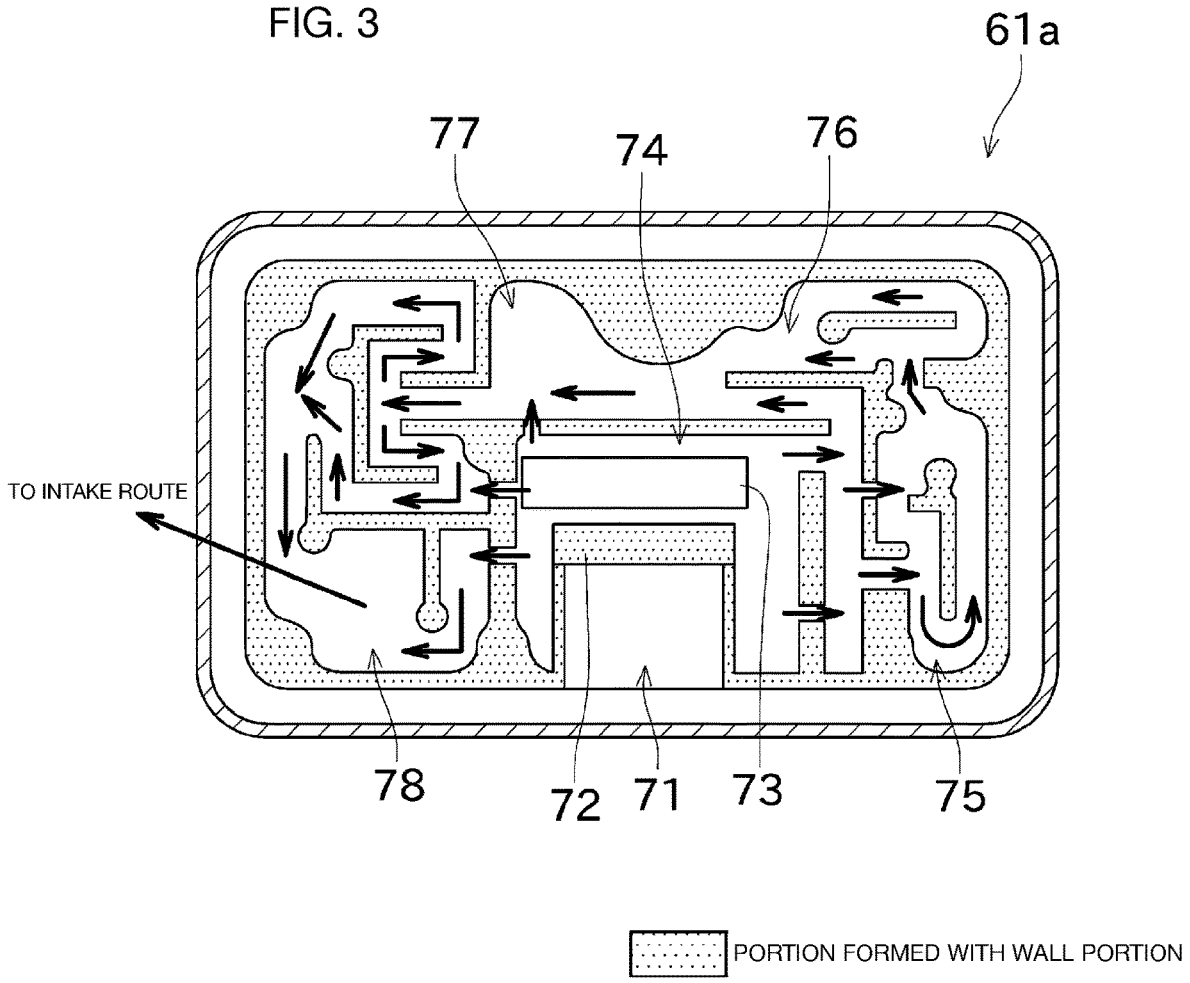
FIG. 3 is a bottom view illustrating an oil separation route formed in a ceiling portion.

As illustrated in FIG. 3, the plural wall portions that are projected downward are formed in the ceiling portion 61*a* of the breather device 61 in this embodiment. The receiving portion 61*b* includes a flat receiving plate 91. When the wall portion that is projected from the ceiling portion 61*a* comes in contact with the receiving plate 91, a space between the ceiling portion 61*a* and the receiving portion 61*b* is partitioned by this wall portion, and the above oil separation route is formed by this configuration. The wall portion that constitutes the oil separation route may be formed not on the ceiling portion 61*a* side but on the receiving portion 61*b* side.

As illustrated in FIG. 3, the ceiling portion 61*a* is formed with an introduction portion 71. The introduction portion 71 is a portion that is surrounded by the wall portion. In addition, as illustrated in FIG. 5, the receiving plate 91 of the receiving portion 61*b* is formed with an oil return hole 92 at a position corresponding to the introduction portion 71. The blow-by gas that is produced in the engine body 5 flows to the introduction portion 71 via the oil return hole 92. A guide plate 72 as one of the wall portions for partitioning the introduction portion 71 is formed with a clearance at an upper end (a deep side of the sheet in FIG. 3). The blow-by gas that has flowed to the introduction portion 71 flows through the clearance at the upper end of the guide plate 72 and then flows down. A catching net 73 is arranged in a route through which this blow-by gas flows down. The catching net 73 is configured to be able to catch the engine oil contained in the blow-by gas. The engine oil caught by the catching net 73 returns to the oil pan 51 via the cylinder block 52 and the cylinder head 53 through the oil return hole 92.

The catching net 73 can catch only some of the engine oil. For example, the engine oil mist having a small particle diameter tends to pass through the catching net 73. In the oil separation route, the engine oil mist contained in the blow-by gas, which has passed through the catching net 73, is separated and collected.

As illustrated in FIG. 3, the oil separation route includes a first region 74, a second region 75, a third region 76, a fourth region 77, and a fifth region 78. In FIG. 3, a flow direction of the blow-by gas is indicated by a bold arrow. The first region 74 is a region where the introduction portion 71, the guide plate 72, and the catching net 73 are arranged. The blow-by gas that has been introduced in the breather device 61 first flows through the first region 74. The second region 75 to the fifth region 78 are arranged around the first region 74. The second region 75 to the fifth region 78 are directly connected to the first region 74. As a result, the blow-by gas introduced from the introduction portion 71 also flows to all the regions from the second region 75 to the fifth region 78. The second region 75 to the fifth region 78 are mutually connected in an order of the region numbers. The blow-by gas introduced from the introduction portion 71 finally flows to the fifth region 78 regardless of the mediating route. A route, which is not illustrated and is connected to the above-described PCV valve 63, is formed in the fifth region 78. Accordingly, the blow-by gas guided to the fifth region 78 flows to the intake route via the PCV valve 63.

In each of the second region 75, the third region 76, and the fourth region 77, a portion where the route is branched, a portion where the branched routes are merged, a portion where a direction of the route is changed (particularly, a portion where the direction of the route is changed 180 degrees and reversed), and the like are formed. The separated engine oil drops to the receiving plate 91 of the receiving portion 61*b*, and then finally returns to the oil pan 51 via the oil return hole 92.

A detailed description will hereinafter be made on the routes in the fourth region 77 and the separation of the engine oil from the blow-by gas. As illustrated in FIG. 4, a first route 81, an acceleration route 82, a branching route 83, a turn-back route 84, a reverse route 85, and a merging route 86 are formed in the fourth region 77.

In the route from the third region 76 to the fifth region 78 via the fourth region 77, the first route 81 is a route on the most upstream side in the fourth region 77. Accordingly, the blow-by gas that has flowed through the third region 76 is introduced into the first route 81. In addition, the blow-by gas that has directly flowed from the first region 74 (without the second region 75 and the third region 76 being intervened) is introduced into the first route 81.

The acceleration route 82 is a straight route that is connected to a downstream end of the first route 81. The acceleration route 82 has a smaller channel cross-sectional area than another route such as the first route 81. More specifically, a height in a vertical direction of the acceleration route 82 is lower than heights of the first route 81 and the other routes. In other words, an upper surface of the acceleration route 82 is located lower than those of the other routes (located on a near side of the sheet from the other routes in FIG. 4). In this way, a flow rate of the blow-by gas can be increased by the acceleration route 82.

The acceleration route 82 may be configured to have the smaller channel cross-sectional area than the others by reducing an axial length to be shorter than those of the other routes. In addition, a shape of the acceleration route 82 is not limited to the straight-line shape, and the acceleration route 82 may include a curved portion.

The branching route 83 is connected to a downstream end of the acceleration route 82. The branching route 83 includes a wall portion that is orthogonal to a direction of the acceleration route 82 (a direction along the route or an advancing direction, the same applies hereinafter). In the case where the acceleration route 82 is not the straight route, a direction of a portion of the acceleration route 82 that is connected to the branching route 83 (that is, a most downstream route) only needs to be orthogonal to the wall portion of the branching route 83. When the high-speed blow-by gas that has flowed along the acceleration route 82 collides with the wall portion of the branching route 83, the particles of the engine oil mist are separated. As illustrated in FIG. 4, in particular, the particles, each of which has a large diameter and is easily affected by inertia, are easily separated in this wall portion.

The branching route 83 includes a portion that is branched into two routes by this wall portion. These two routes are formed in a direction along the wall portion, and thus are orthogonal to the acceleration route 82. In addition, directions of these two routes differ from each other by 180 degrees. When the branched portions are provided along with the wall portion, just as described, the flow of the blow-by gas around the wall portion can be complicated. In this way, it is possible to further reliably separate the engine oil from the blow-by gas.

The two routes that are branched in the branching route 83 may not be orthogonal to the acceleration route 82. That is, in order to cause the blow-by gas to collide with the wall portion (to prevent the flow thereof along the wall portion), the wall portion of the branching route 83 has to be orthogonal to the acceleration route 82. However, the directions of the two routes may be changed from this wall portion and may thereby be separated. In addition, a difference in the directions of the two routes that are branched in the branching route 83 may be other than 180 degrees.

The turn-back route 84 is connected to a downstream end of the branching route 83. The two downstream ends of the branching route 83 are present, and the turn-back route 84 is formed at each of the two downstream ends. The turn-back route 84 may be connected to only one of the downstream ends of the branching route 83. The turn-back route 84 is a route that is parallel to the acceleration route 82 and an advancing direction of which is opposite from that of the acceleration route 82. The engine oil that is not separated by the collision with the wall portion of the branching route 83 tends to flow as is along the wall portion. Thus, when the direction of the route is significantly changed, the engine oil having the particularly large particle diameter is collected. In this way, it is possible to further reliably separate the engine oil from the blow-by gas.

The reverse route 85 is connected to a downstream end of each of the two turn-back routes 84. The reverse route 85 is a route, a direction of which is changed such that an advancing direction thereof is changed by 180 degrees. The reverse route 85 may be connected to one of the branched routes by the branching route 83 via the turn-back route 84.

The reverse route 85 in this embodiment is not reversed in an arc shape but is reversed by two right-angled routes. More specifically, the reverse route 85 is formed with, as an outer wall portion constituting the reverse route 85, a first wall portion 85*a*, a second wall portion 85*b*, and a third wall portion 85*c*. These three wall portions are directly connected to each other without an arcuate surface or the like being interposed. In other words, two routes, directions of which are changed at right angle, are provided. Compared to the routes that are connected to each other via the arcuate surface, in such routes, the flow of the blow-by gas stagnates or is disturbed, or the flow rate of the blow-by gas is reduced. In particular, the engine oil having the small particle diameter has light weight, easily flows along the flow, and is less likely to be affected by the inertia. Thus, such engine oil tends to be collected in a location where the stagnation or the like occurs. In view of this, wall surfaces that are connected at right angle are provided on an outer side of the route. In this way, it is possible to further reliably separate the engine oil having the small particle diameter. The wall surfaces that are connected at right angle may be provided not only to the reverse route 85 but also to another route.

The merging route 86 is a route in which the two branched routes by the branching route 83 merge. In the merging route 86, the engine oil collides with each other, which makes it easy to separate the engine oil from the blow-by gas. In particular, there is a case where the engine oil having the large particle diameter is integrated after the collision with each other, collides with the wall portion, and is consequently separated from the blow-by gas. Thus, in the merging route 86, a wall portion preferably exists at a position where at least one of the two merging routes is extended. The blow-by gas that has flowed through the merging route 86 flows into the above-mentioned fifth region 78, and then flows into an intake system.

At least one of the first route 81 to the merging route 86 is also provided in the regions other than the fourth region 77. Thus, in such regions, it is possible to exert a similar effect to that described above and thus to separate the engine oil.

Figure 6:
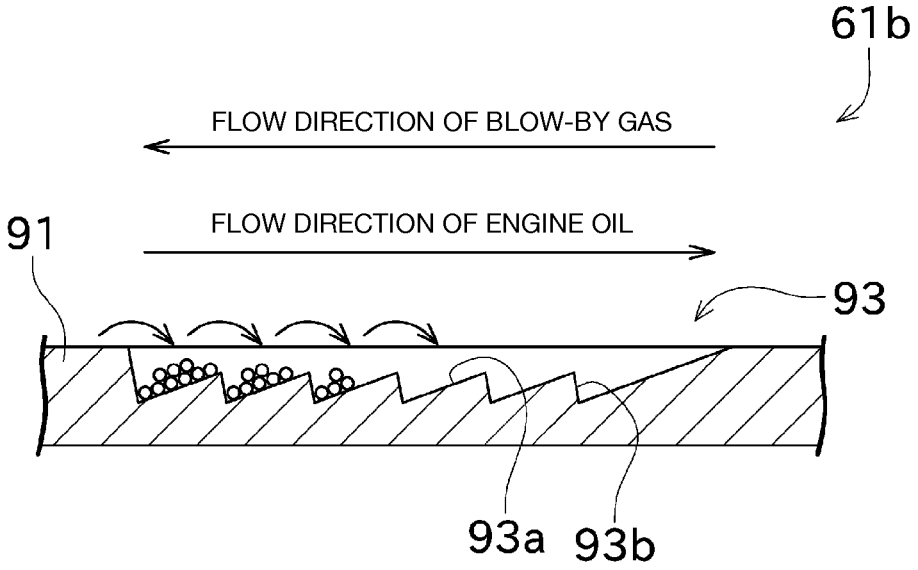
FIG. 6 is a cross-sectional view illustrating an up portion and a down portion of the oil delivery portion.

Next, a description will be made on a configuration of an oil delivery portion 93 with reference to FIG. 5 and FIG. 6. The oil delivery portion 93 that is formed in the receiving plate 91 delivers the engine oil separated by the oil separation route. In this embodiment, since the oil return hole 92 and the introduction portion 71 are located at the same position, it is necessary to deliver the engine oil in the reverse direction from the advancing direction of the blow-by gas in at least in part. In FIG. 5, a direction in which the oil delivery portion 93 delivers the engine oil is indicated by bold arrows. In such portions, the oil delivery portion 93 is formed. The oil delivery portion 93 is configured to be able to guide the engine oil in a different direction from the flow direction of the blow-by gas.

More specifically, the oil delivery portion 93 is configured in a step shape in which an up portion 93*a* and a down portion 93*b* are continuously and repeatedly provided. The up portion 93*a* is a portion, a height of which is increased toward the downstream side of the route through which the engine oil returns. The down portion 93*b* is a portion, a height of which is reduced toward the downstream side of the route through which the engine oil returns. The height of the down portion 93*b* is more steeply changed than that of the up portion 93*a*.

Here, since the engine 100 vibrates, a delivery force of this vibration can move the engine oil on the slight gradient by the vibration. Thus, the engine oil can climb the up portion 93*a*. Needless to say, the engine oil can also flow down the down portion 93*b*. Furthermore, since the height of the down portion 93*b* is steeply changed, the engine oil cannot climb the down portion 93*b* by the vibration. Thus, the engine oil cannot move reversely in the down portion 93*b*. As described so far, the engine oil moves along the flow direction thereof in the oil delivery portion 93. In particular, in this embodiment, the oil delivery portion 93 is formed at a position that is recessed downward from the receiving plate 91 (in other words, an upper end of the up portion 93*a* is located on a lower side of the receiving plate 91). Accordingly, the engine oil is less likely to be affected by the blow-by gas that flows reversely. Thus, it is possible to further reliably move the engine oil. Furthermore, the engine oil can be pooled in this groove-shaped portion.

As it has been described so far, the breather device 61 in this embodiment separates the engine oil contained in the blow-by gas. This breather device 61 includes the first route 81, the acceleration route 82, the branching route 83, and the turn-back route 84. The blow-by gas flows through the first route 81. The acceleration route 82 is connected to the downstream side of the first route 81 and has the smaller channel cross-sectional area than the first route 81. The branching route 83 is connected to the downstream side of the acceleration route 82, includes the wall portion that is orthogonal to the acceleration route 82, and is branched into two routes by the wall portion. The turn-back route 84 is connected to one of the branched routes of the branching route 83, and turns back in a manner to be parallel to the acceleration route 82 and obtain the reverse advancing direction from that of the acceleration route 82.

In this way, the engine oil mist contained in the blow-by gas is carried by the blow-by gas, the flow rate of which is increased in the acceleration route 82, and collides with the wall portion in the branching route 83. As a result, the engine oil can be separated from the blow-by gas. In addition, since the turn-back route 84 causes the blow-by gas to turn back, the engine oil can be separated from the blow-by gas by inertia.

In regard to the breather device 61 of this embodiment, the breather device 61 includes the portion (a corner portion) in which the advancing direction of the route is changed by 90 degrees. The outer wall portions (a pair of the first wall portion 85*a* and the second wall portion 85*b* and a pair of the second wall portion 85*b* and the third wall portion 85*c*) constituting this corner portion are constructed of the two wall portions that are orthogonal to each other and are connected to each other.

In this way, compared to the case where the wall portions constituting the outer side of the corner portion are connected by the arcuate surface, the flow of the blow-by gas is likely to be disturbed and stagnate, and the flow rate of the blow-by gas is likely to be reduced. In particular, the engine oil mist having the small particle diameter is likely to be collected in the location, where the stagnation occurs, on the outer side of the corner portion. As a result, it is possible to further reliably separate the engine oil from the blow-by gas.

The breather device 61 of this embodiment includes the merging route that is formed on the downstream side of the branching route 83 and that merges the two branched routes of the branching route 83.

As a result, the engine oil that is contained in the two branched routes can collide with each other. Thus, it is possible to further reliably separate the engine oil from the blow-by gas.

The breather device 61 of this embodiment includes the receiving portion 61*b* that receives the engine oil separated from the blow-by gas. The receiving portion 61*b* includes the oil delivery portion 93 that delivers the engine oil separated from the blow-by gas. The oil delivery portion 93 is the stepped groove portion in which the up portion 93*a* and the down portion 93*b* are alternately and repeatedly provided. The height of the up portion 93*a* is increased toward the downstream side of the route through which the engine oil returns. The height of the down portion 93*b* is reduced toward the downstream side of the route through which the engine oil returns. The height of the down portion 93*b* is changed more steeply than that of the up portion 93*a*.

In this way, the engine oil can move along the up portion 93*a* by the vibration of the engine. Meanwhile, since the height of the down portion 93*b* is steeply changed, the engine oil is less likely to flow reversely. As a result, it is possible to further reliably move the engine oil.

The engine 100 of this embodiment includes the breather device 61 and the vaporizer 33. The vaporizer 33 vaporizes the liquid fuel by using the heat of the coolant. When the coolant that has been subjected to the heat exchange with the vaporizer 33 flows through the breather device 61, the breather device 61 is cooled.

As a result, it is possible to increase the viscosity of the engine oil by cooling the blow-by gas in the breather device 61 using the coolant, the temperature of which has been reduced by the heat exchange with the vaporizer 33. Thus, it is possible to further reliably separate the engine oil from the blow-by gas.

The preferred embodiment of the present invention has been described so far. However, the above configuration can be modified as follows, for example.

The oil separation route described in the above embodiment is an example, and a different route may be formed.

The engine 100 may include a supercharger that suctions the air by using an exhaust turbine and a compressor. In this case, the compressor is arranged between the air cleaner 12 and the throttle valve 13 in the intake route.

DESCRIPTION OF REFERENCE NUMERALS

61 Breather device
81 First route
82 Acceleration route
83 Branching route
84 Turn-back route
85 Reverse route
100 Engine

The invention claimed is:

1. A breather device that separates engine oil contained in blow-by gas, the breather device comprising:

a first route through which the blow-by gas flows;

an acceleration route that is connected to a downstream side of the first route and has a smaller channel cross-sectional area than the first route;

a branching route that is connected to a downstream side of the acceleration route, includes a wall portion that is orthogonal to the acceleration route, and is branched into two routes by the wall portion; and a turn-back route that is connected to one of the branched routes of the branching route and is turned back in a manner to be parallel to the acceleration route and to have a reverse advancing direction from that of the acceleration route.

2. The breather device according to claim 1 further comprising:

a portion in which an advancing direction of the route is changed by 90 degrees, wherein outer wall portions constituting the portion are constructed of two wall portions that are orthogonal to each other and are connected to each other.

3. The breather device according to claim 1 further comprising:

a merging route that is formed on a downstream side of the branching route and that merges the two branched routes of the branching route.

4. The breather device according to claim 1, further comprising:

a receiving portion that receives the engine oil separated from the blow-by gas, wherein the receiving portion includes an oil delivery portion that delivers the engine oil separated from the blow-by gas, the oil delivery portion is a stepped groove portion in which an up portion and a down portion are alternately and repeatedly provided, a height of the up portion being increased toward a downstream side of a route through which the engine oil returns, and a height of the down portion being reduced toward the downstream side of the route through which the engine oil returns, and the height of the down portion is changed more steeply than that of the up portion.

5. An engine comprising:

the breather device according to claim 1; and a vaporizer that vaporizes liquid fuel by using heat of an engine coolant, wherein the breather device is cooled when the engine coolant that has been subjected to heat exchange with the vaporizer flows through the breather device.

* * * * *